US007204104B2

(12) United States Patent
Kim et al.

(10) Patent No.: US 7,204,104 B2
(45) Date of Patent: Apr. 17, 2007

(54) DAMPER OF DRUM TYPE WASHING MACHINE

(75) Inventors: Young-Ho Kim, Seoul (KR); Joon-Woo Kim, Gyeonggi-Do (KR); Dong-Won Kim, Gyeonggi-Do (KR); Seung-Chul Park, Gyeonggi-Do (KR); Si -Moon Jeon, Seoul (KR); Gwan-Ryong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 237 days.

(21) Appl. No.: 10/755,139

(22) Filed: Jan. 12, 2004

(65) Prior Publication Data

US 2004/0148976 A1 Aug. 5, 2004

(30) Foreign Application Priority Data

Jan. 30, 2003 (KR) ..... 10-2003-0006430
May 15, 2003 (KR) ..... 10-2003-0031011

(51) Int. Cl.
*D06F 37/20* (2006.01)

(52) U.S. Cl. ..... 68/23.1; 188/294; 188/284; 188/305; 188/322.22; 188/322.16; 188/322.17; 188/322.18

(58) Field of Classification Search ..... 68/23.1; 188/284, 294, 305, 322.16, 322.17, 322.18, 188/322.22
See application file for complete search history.

(56) References Cited

U.S. PATENT DOCUMENTS 3,593,977 A * 7/1971 Hahn ..... 267/64.19
4,481,974 A * 11/1984 Schmitt et al. ..... 137/514
4,583,621 A * 4/1986 Tangorra ..... 188/67
4,821,852 A * 4/1989 Yokoya ..... 188/322.15
5,948,021 A * 9/1999 Radcliffe ..... 623/44
6,053,291 A * 4/2000 Shibahata et al. ..... 188/271
6,264,014 B1 * 7/2001 Ferlicca ..... 188/129
6,955,248 B2 * 10/2005 Park et al. ..... 188/267

FOREIGN PATENT DOCUMENTS

EP 301190 A1 * 2/1989
EP 407755 A1 * 1/1991
EP 806514 A2 * 11/1997
JP 8-103594 A 4/1996
WO WO 9950568 A2 * 10/1999

* cited by examiner

*Primary Examiner*—Michael Barr
*Assistant Examiner*—Sarah E Husband
(74) *Attorney, Agent, or Firm*—Birch, Stewart & Kolasch & Birch, LLP

(57) ABSTRACT

A damper includes: a cylinder: a piston rod inserted to be movable linearly in the cylinder; a guide member provided with a coupling hole to which an insertion portion of the rod member is coupled at a center thereof, and provided with first and second grooves at an outer circumferential surface thereof; a fixed damping member fitted into the first groove and adhered to an inner surface of the cylinder; and a movable damping member up and down movably fitted into the second groove and selectively adhered to the inner surface of the cylinder.

5 Claims, 10 Drawing Sheets

DAMPER OF DRUM TYPE WASHING MACHINE

This Nonprovisional application claims priority under 35 U.S.C. §119(a) on Patent Application No(s) 2003-0006430 and 2003-0031011 filed in Korea on Jan. 30, 2003 and May 15, 2003, respectively, the entire contents of which are hereby incorporated by reference.

BACKGROUND OF THE INVENTION

1. Field of the Invention

The present invention relates to a damper of a drum type washing machine, and more particularly, to a damper of a drum type washing machine capable of attenuating vibration transmitted to a tub at the time of a washing operation.

2. Description of the Conventional Art

FIG. 1 is a longitudinal section view of a drum type washing machine in accordance with the conventional art.

As shown, the conventional drum type washing machine 10 comprises a cabinet 11 for forming an appearance; a tub 12 arranged in the cabinet 11 for storing washing water; a drum 13 rotatably arranged in the tub 12 for performing a washing operation and a dehydrating operation for laundry; and a driving motor 14 positioned at a rear side o the tub 12 and connected to a rotation shaft 13*a* of the drum 13.

A door 15 through which laundry is put in or taken out is rotatably arranged at a front surface of the cabinet 11, and a bracket 16 for supporting the rotation shaft 13*a* of the drum 13 is arranged at a rear surface of the tub 12.

A spring 17 is fixed to the cabinet 11 at an upper portion of the tub 12, and a damper 20 for attenuating vibration transmitted to the tub 12 by the drum 13 is arranged at a lower portion of the tub 12.

FIG. 2 is a longitudinal section view showing the damper of the drum type washing machine in accordance with the conventional art.

As shown, the conventional damper 20 comprises a cylinder 21 fixed to the cabinet 11 and having an accommodating portion 21*a;* a rod 22 fixed to the tub 12 and arranged to be inserted/detachable into/from the accommodating portion 21*a* of the cylinder 21; and a damping 23 coupled to an outer circumferential surface of the rod 22 and contacting a frictional surface 21*b* of the cylinder 21.

Operation of the conventional damper will be explained as follows.

At the time of a washing operation, force is applied to the rod 22 downwardly due to vibration transmitted to the tub by the drum. At this time, the damping 23 comes into contact with the frictional surface 21*b* of the cylinder 21 thus to generate a frictional force. According to this, the rod 22 gradually moves thus to attenuate vibration transmitted to the tub 12.

In order to attenuate vibration transmitted to the tub 12, the damping 23 has to be designed by sufficiently considering a frictional force thereof. However, in the damper of the conventional drum type washing machine, vibration widths generated at the time of a normal dehydration operation and an excessive dehydration operation under a substantial washing operation are greatly different to each other, thereby having a limitation in efficiently attenuating both vibrations of a great width and a less width.

In the conventional damper of the drum type washing machine, a frictional force of the damping is constantly maintained at all times, so that both vibrations of a great width and a less width are not efficiently attenuated. Also, when a frictional force of the damping is excessively great or less, noise is generated and a lifespan of the drum type washing machine is reduced.

SUMMARY OF THE INVENTION

Therefore, an object of the present invention is to provide a damper of a drum type washing machine capable of efficiently attenuating vibration according to a width size of vibration transmitted to a tub at the time of a washing operation.

To achieve these and other advantages and in accordance with the purpose of the present invention, as embodied and broadly described herein, there is provided a damper of a drum type washing machine comprising: a cylinder: a piston rod inserted to be movable linearly in the cylinder; a guide member provided with a coupling hole to which an insertion portion of the rod member is coupled at a center thereof in order to attenuate vibration according to a width size of vibration transferred to a tub by multi-stage, and provided with first and second grooves at an outer circumferential surface thereof; a fixed damping member fitted into the first groove and adhered to an inner surface of the cylinder; and a movable damping member up and down movably fitted into the second groove and selectively adhered to the inner surface of the cylinder.

To achieve these and other advantages and in accordance with the purpose of the present invention, as embodied and broadly described herein, there is also provided a damper of a drum type washing machine comprising: a cylinder: a piston rod inserted to be movable linearly in the cylinder; a damping member mounted at the piston rod and generating a damping force by rubbing against the inner circumferential surface of the cylinder; and a damping force transfer means mounted between the piston rod and the damping member and generating a damping force only when a vibration transferred through the cylinder or the piston rod is greater than a pre-set displacement value.

The damping force transfer means comprises: a first slot formed at the piston rod and having a predetermined length in a longitudinal direction; a support member disposed slidably at an outer circumferential surface of the piston rod and having a second slot disposed facing the first slot; and a ball inserted to be rolled in the ball chamber formed by the first slot and the second slot.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a damper of a drum type washing machine according to the present invention will be explained as follows.

Figure 1:
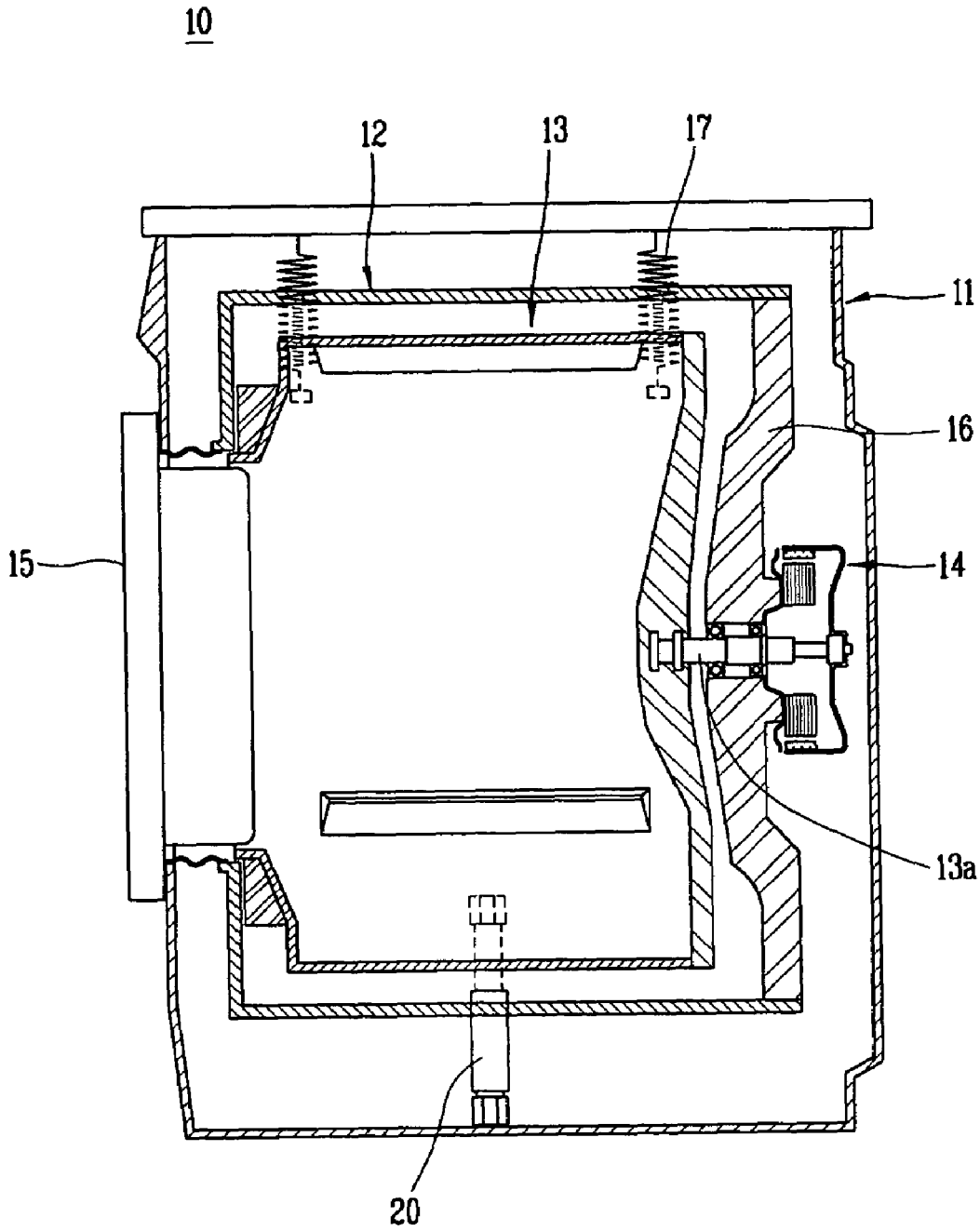
FIG. 1 RELATED ART
FIG. 1 is a longitudinal section view showing a drum type washing machine in accordance with the conventional art.
Figure 2:
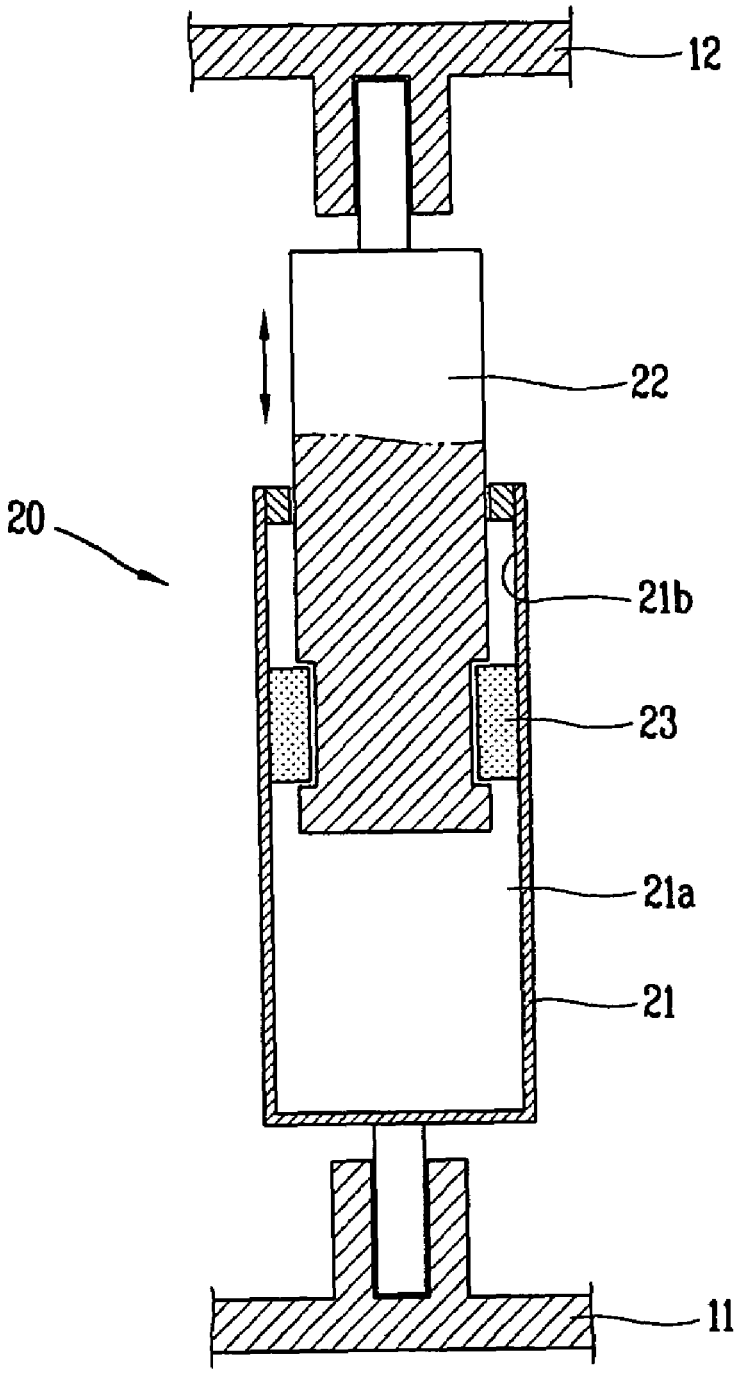
FIG. 2 RELATED ART
FIG. 2 is a longitudinal section view showing a damper of the drum type washing machine in accordance with the conventional art.
Figure 3:
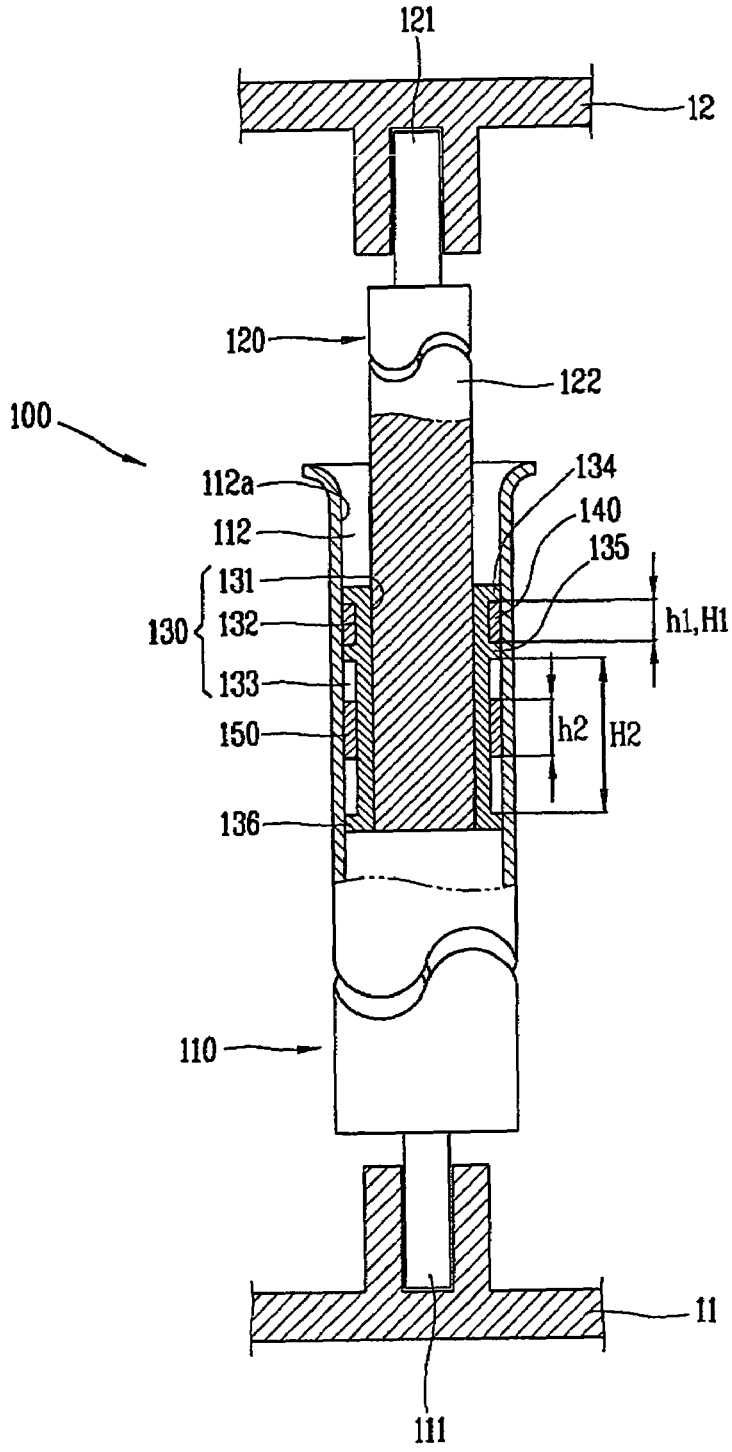
FIG. 3 is a longitudinal section view showing a first embodiment of a damper of a drum type washing machine according to the present invention, which shows vibration attenuation at the time of a normal dehydration operation.
Figure 4:
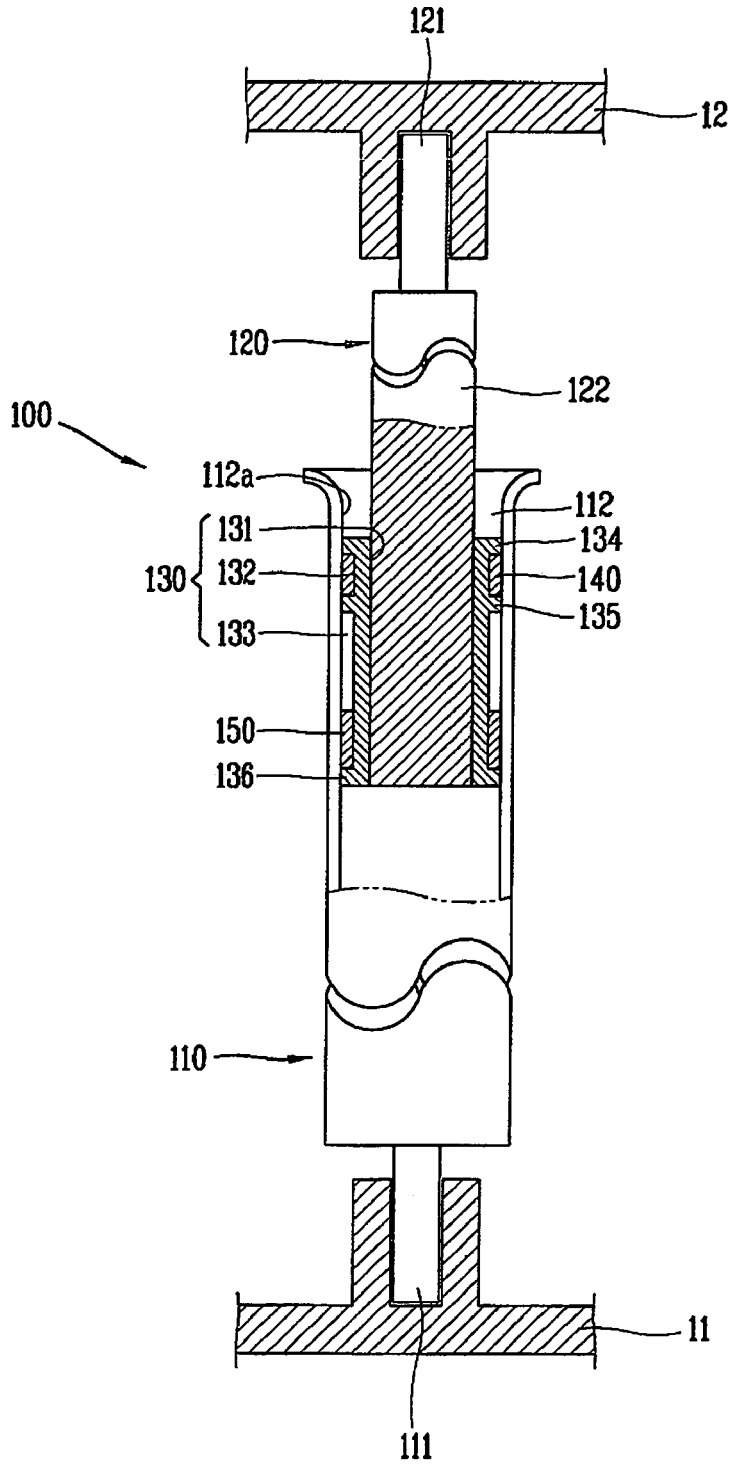
FIG. 4 is a longitudinal section view showing vibration attenuation at the time of an excessive dehydration operation in FIG. 3.
Figure 5:
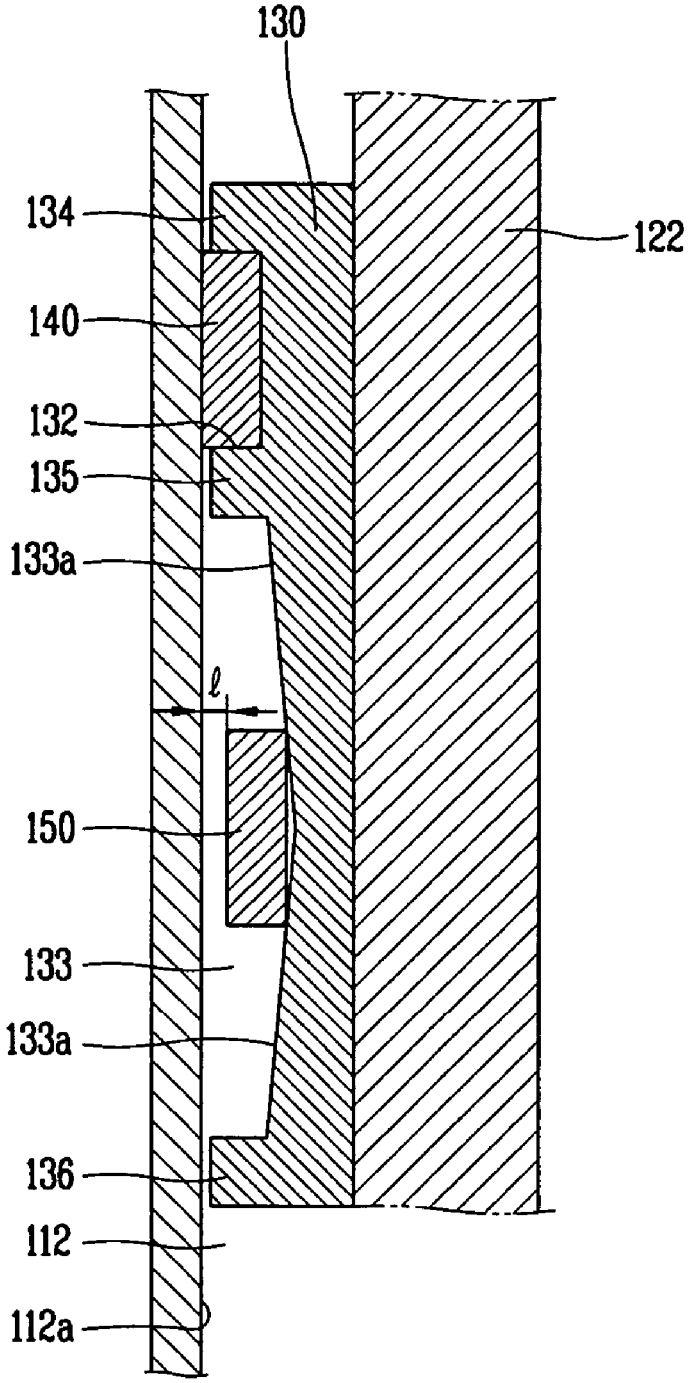
FIG. 5 is a longitudinal section view showing a modification example of a second groove of FIG. 3.

FIG. 3 is a longitudinal section view showing a first embodiment of a damper of a drum type washing machine according to the present invention, which shows vibration attenuation at the time of a normal dehydration operation, FIG. 4 is a longitudinal section view showing vibration attenuation at the time of an excessive dehydration operation in FIG. 3, and FIG. 5 is a longitudinal section view showing a modification example of a second groove of FIG. 3.

As shown, a damper 100 of a drum type washing machine according to the present invention comprises: a cylinder 110 provided with a hinge connection portion 111 to be fixed to a cabinet 11 of a drum type washing machine at one side thereof, and provided with an accommodating portion 112 at another side thereof a rod member 120 provided with a hinge connection portion 121 to be fixed to a tub 12 of the drum type washing machine at one side thereof, and provided with an insertion portion 122 to be elastically inserted into the accommodating portion 112 at another side thereof a guide member 130 provided with a coupling hole 131 to which the insertion portion 122 of the rod member 120 is coupled at a center thereof, and provided with a first groove 132 and a second groove 133 at an outer circumferential surface thereof, the guide member for attenuating vibration transmitted to the tub 12 according to a width size by multi-stage; a fixed damping member 140 inserted into the first groove 132 and adhered to an inner surface of the cylinder 110; and a movable damping member 150 up-down movably fitted into the second groove 133 and selectively adhered to an inner surface (frictional surface 112*a*) of the cylinder 110.

The hinge connection portion 111 of the cylinder 110 can be fixed not only to the cabinet 11 but also to the tub 12. Also, the hinge connection portion 121 of the rod member 120 can be fixed not only to the tub 12 but also to the cabinet 11.

A height H1 of the first groove 132 is the same as a height h1 of the fixed damping member 140 in order to fit the fixed damping member 140 into the first groove 132 without movement. On the contrary, a height H2 of the second groove 133 is higher than a height h2 of the movable damping member 150 in order to move the movable damping member 150 up and down while being fitted into the second groove 133.

Stoppers 135, 134, and 136 contacting the frictional surface 112*a* of the cylinder 110 and limiting positions of the fixed damping member 140 and the movable damping member 150 are respectively formed between the first groove 132 and the second groove 133, and at both sides of the first and second grooves 132 and 133.

The fixed damping member 140 maintains a frictional force constantly by contacting the frictional surface 112*a* of the cylinder 110, but the movable damping member 150 varies a frictional force with the cylinder 110 according to a vibration width of the tub 12.

That is, when vibration width of the tub 12 is less like in the case of a normal dehydration operation, the movable damping member 150 is positioned at a middle portion of the second groove 133 thus not to contact the frictional surface 112*a* of the cylinder 110. However, when vibration width of the tub 12 is great like in the case of an excessive dehydration operation, the movable damping member 150 is positioned at both sides of the second groove 133 thus to contact the frictional surface 112*a* of the cylinder 110.

Like this, when vibration width of the tub 12 is less like in the case of a normal dehydration operation, the fixed damping member 140 attenuates vibration, and when vibration width of the tub 12 is great like in the case of an excessive dehydration operation, not only the fixed damping member 140 but also the movable damping member 150 attenuate vibration. According to this, damping (vibration attenuation) can be performed by multi-stage according to vibration width of the tub 12.

Also, as shown in FIG. 5, an inclination surface 133*a* that a middle portion thereof is more concaved than both ends can be formed at a bottom surface of the second groove 133.

An interval l between the frictional surface 112*a* of the cylinder 110 and the movable damping member 150 is generated by the inclination surface 133*a*, thereby more smoothly performing vibration attenuation of multi-stage.

Figure 6:
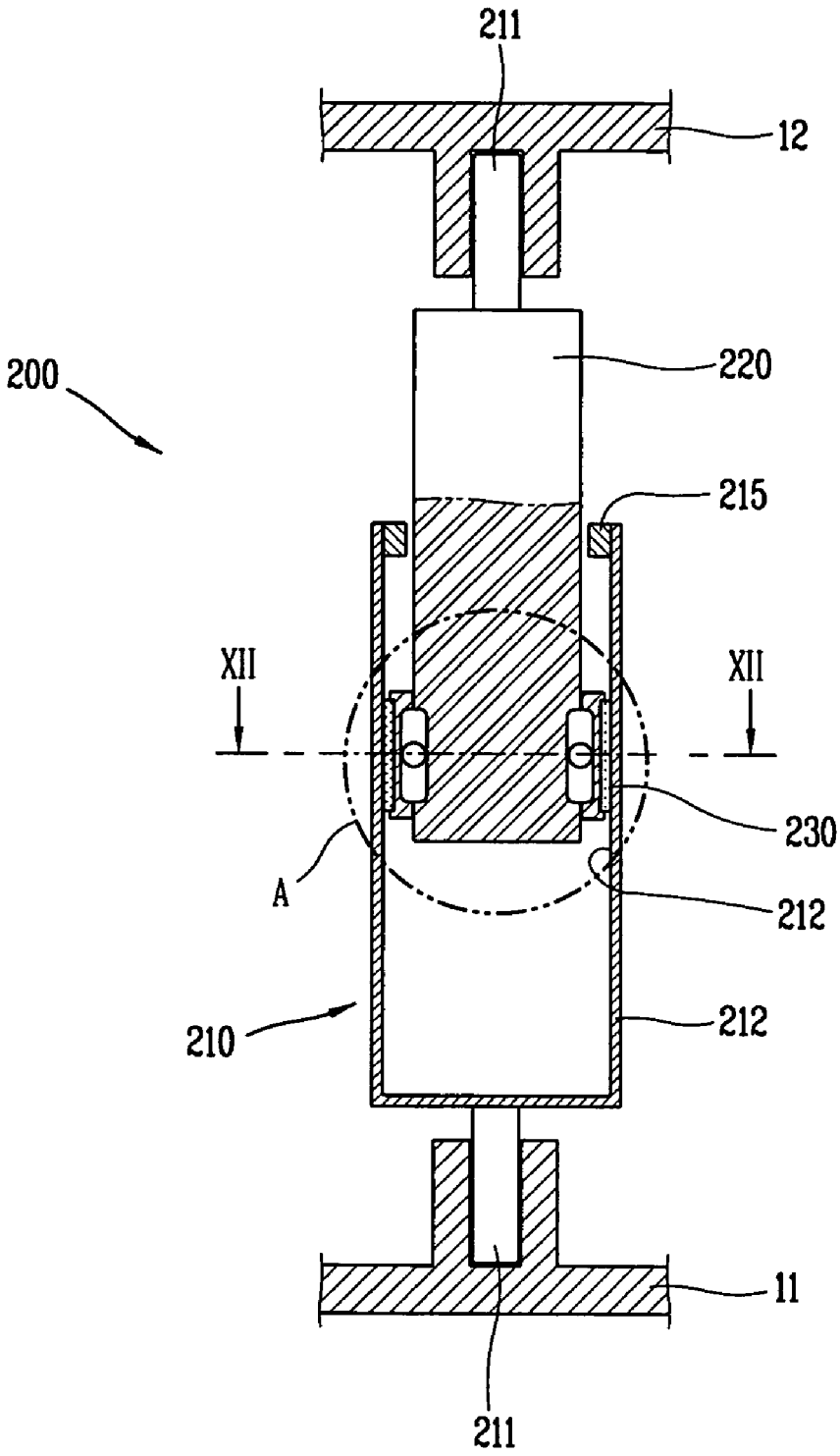
FIG. 6 is a sectional view showing a damper in accordance with a second embodiment of the present invention.
Figure 7:
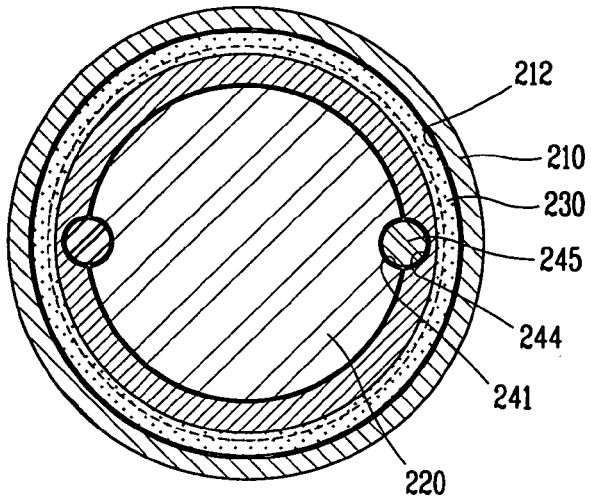
FIG. 7 is a sectional view taken along line XII—XII of FIG. 6.
Figure 8:
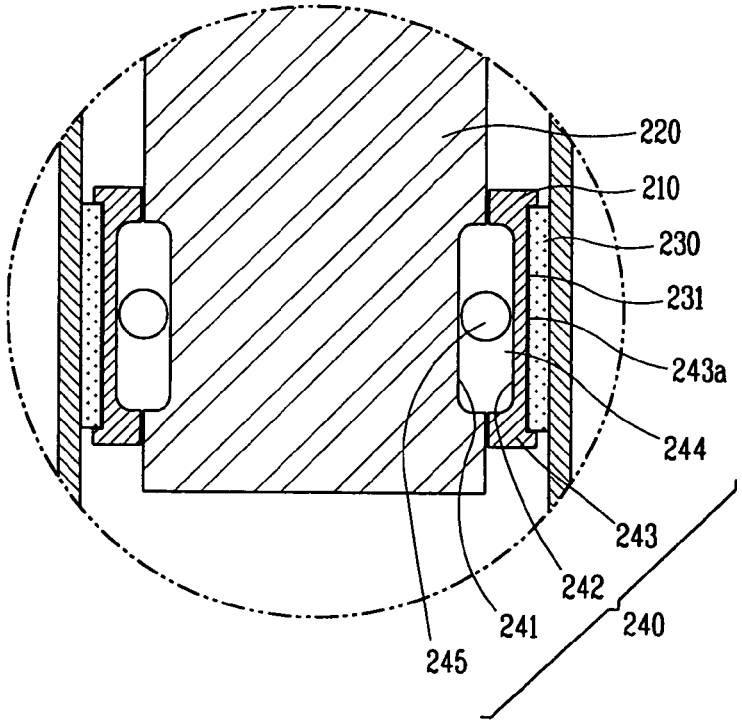
FIG. 8 is an enlarged view of a portion 'A' of FIG. 6.

FIG. 6 is a sectional view showing a damper in accordance with a third embodiment of the present invention, FIG. 7 is a sectional view taken along line XII—XII of FIG. 6, and FIG. 8 is an enlarged view of a portion 'A' of FIG. 6.

A damper 200 in accordance with the second embodiment of the present invention includes: a cylinder 210 mounted at a bottom surface of the cabinet 11, a piston rod 220 mounted at an outer circumferential surface of the tub 12 and inserted to be movable linearly into the cylinder 210, a damping member 230 mounted at the piston rod 220 and generating a damping force by rubbing on the inner circumferential surface of the cylinder 210, and a damping force transfer means 240 mounted between the piston rod 220 and the damping member 230, not transferring an operational force to the damping member 230 if a displacement value of the piston rod 220 according to a vibration generated from the tub 12 is smaller than a pre-set value, and transferring an operational force to the damping member 230 if a vibration of the tub is so strong that the displacement value of the piston rod 220 goes beyond the pre-set value.

A hinge connection portion 211 is formed at a lower side of the cylinder 210 and hinged at a bottom surface of the cabinet 11. The upper side of the cylinder 210 is opened so that the piston rod 220 can be inserted thereinto. A guide bush 215 for guiding a linear movement of the piston rod 220 is mounted at an inner circumferential surface of the opened upper side of the cylinder 210.

A hinge connection portion 221 is formed at the upper side of the piston rod 220, and a damping force transfer means is installed at an outer circumferential surface of the lower side of the piston rod 220.

The damping force transfer means 240 includes a first slot 241 formed at one side of the piston rod 220 and having a predetermined length in a longitudinal direction, a support member 243 slidably disposed at an outer circumferential surface of the piston rod 220, and having a second slot 242 formed in the same shape as the first slot 241 and disposed facing the first slot 241, and a ball 245 inserted to be movable in a ball chamber 244 formed by the first slot 241 and the second slot 242.

Referring to the damping force transfer means 240, one or more damping force transfer means can be formed at the outer circumferential surface of the piston rod 220.

The support member 243 having a cylindrical shape with a predetermined length is slidably inserted to the outer circumferential surface of the piston rod 220. one or more first slot 241 is/are formed at the inner circumferential surface of the support member 243, and a mounting groove 243*a* for fixing the damping member 230 is formed in a circumferential direction at the outer circumferential surface of the support member 243.

The inner circumferential surface of the damping member 230 is insertedly fixed in the mounting groove 243*a* of the support member 243 and the outer circumferential surface of the damping member 230 rubs on the friction face 212 of the cylinder 210, to thereby generate a damping force. The damping member 230 is made of a sponge material with grease absorbed therein.

The operation of the damper in accordance with the second embodiment of the present invention as constructed as described above will now be explained.

Figure 9:
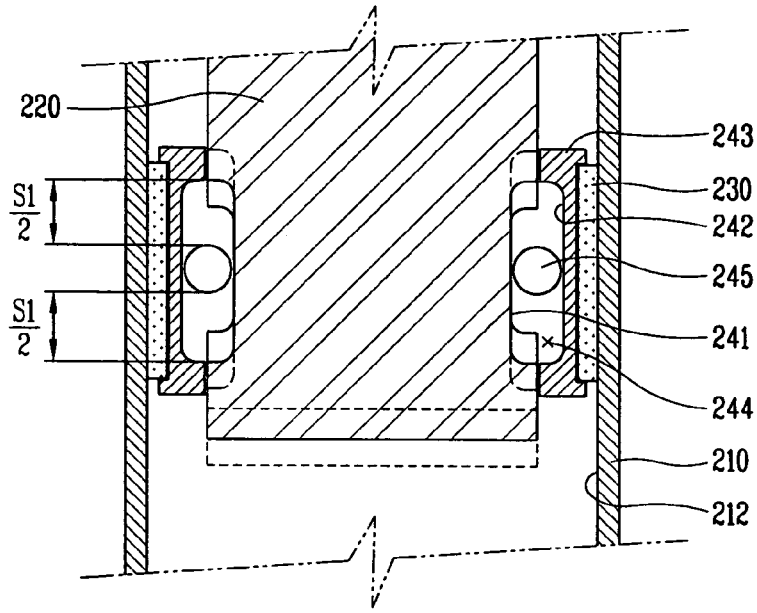
FIG. 9 is a longitudinal section view showing vibration attenuation at the time of a normal dehydration operation.
Figure 10:
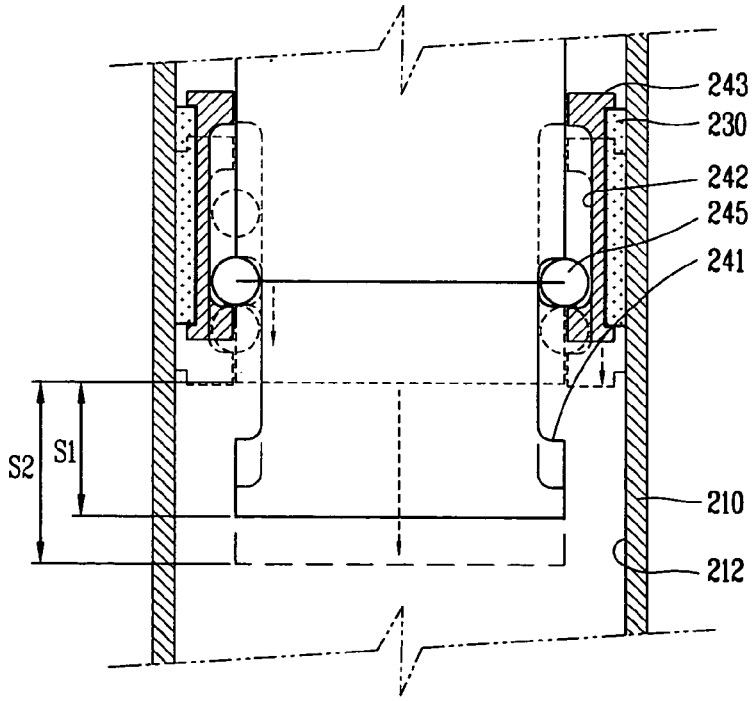
FIG. 10 is a longitudinal section view showing vibration attenuation at the time of an excessive dehydration operation.

FIG. 9 is a longitudinal section view showing vibration attenuation at the time of a normal dehydration operation, FIG. 10 is a longitudinal section view showing vibration attenuation at the time of an excessive dehydration operation.

First, when the washing machine is driven, the tub 12 is vibrated according to rotation of the drum. The vibration of the tub 12 is transferred to the rod 220, according to which the piston rod 220 is moved in a vertical direction. In this case, if the vibration transferred to the piston rod 220 is smaller than a pre-set displacement value, that is, if the piston rod 220 is vibrated vertically within the pre-set displacement value (S1), the ball 245 is rolled inside the ball chamber 244 and the vertical movement of the piston rod 220 is not transferred to the support member 243. Thus, in the case that the vibration transferred from the tub 12 is small, because the damper 200 does not generate a damping force, the vibration is not transferred to the cabinet 11.

The displacement value (S1) is set by a designer depending on a capacity of a washing machine and use conditions, and each length of the first and second slots 241 and 242 are determined according to the set displacement value (S1).

If the vibration transmitted to the piston rod 220 is increased owing to a washing stroke of the washing machine, an amplitude of the piston rod 220 is increased, and accordingly, the vibration is increased beyond the first displacement value (S1), so that the ball 245 may be positioned between the upper end of the first slot 241 and the lower end of the second slot 242 or between the lower end of the first slot 241 and the upper end of the second slot 242.

Accordingly, the vibration of the piston rod 220 is transferred by the ball 245 to the support member 243, and thus, the damping member 230 fixed at the support member 243 rubs on the friction face 212 of the cylinder 210, thereby generating a damping force.

As for the damper 200 in accordance with the second embodiment of the present invention, if an amplitude of the vibration transferred to the piston rod 220 is smaller than the first displacement value (S1), the ball 245 is rolled in the ball chamber 244 to thereby prevent transfer of the vibration of the piston rod 220 to the cabinet 11 through the cylinder 210. If the amplitude of the vibration transferred to the piston rod 220 is increased up to above the first displacement value S1 to reach a predetermined displacement value (S2), the ball 245 is caught at one end of the first slot 241 and the other end of the second slot 242, so that the vibration of the piston rod 220 is transferred to the damping member 230 and as the damping member 230 rubs on the friction face 212, a damping force is generated.

Figure 11:
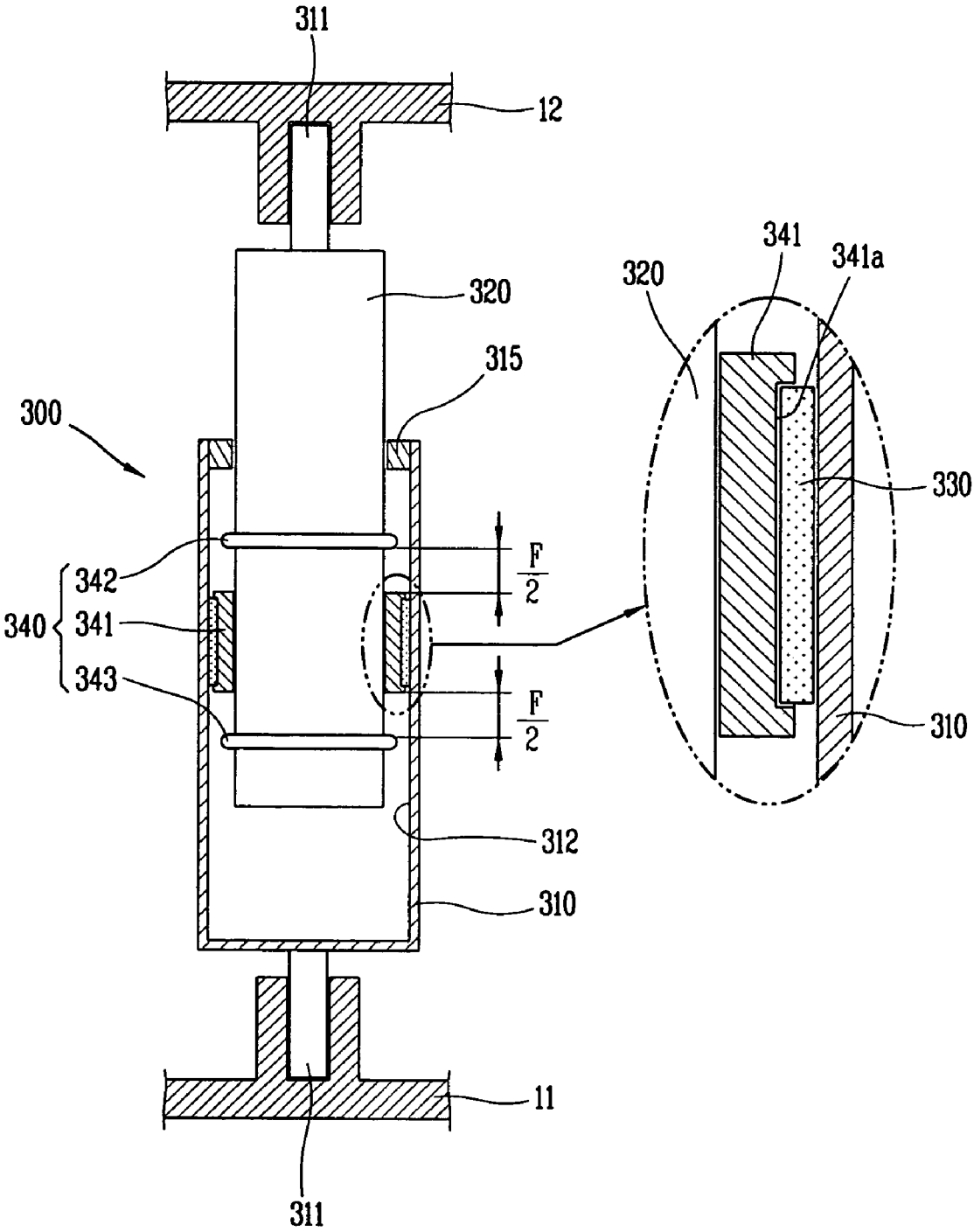
FIG. 11 is a sectional view showing a damper in accordance with a third embodiment of the present invention.

FIG. 11 is a sectional view showing a damper in accordance with a third embodiment of the present invention.

A damper in accordance with a third embodiment of the present invention includes: a cylinder 310 mounted at a bottom surface of the cabinet 11, a piston rod 320 mounted at an outer circumferential surface of the tub 12 and inserted to be movable linearly into the cylinder 310, a damping member 330 mounted at the piston rod 320 and generating a damping force by rubbing on the inner circumferential surface of the cylinder 310, and a damping force transfer means 340 mounted between the piston rod 320 and the damping member 330, not transferring an operational force to the damping member 330 if a displacement value of the piston rod 320 according to a vibration generated from the tub 12 is smaller than a pre-set value, and transferring an operational force to the damping member 330 if a vibration of the tub is so strong that the displacement value of the piston rod 320 goes beyond the pre-set value.

The damping force transfer means 340 of the damper 300 of the third embodiment of the present invention includes a support member 341 slidably disposed at an outer circumferential surface of the piston rod 320 and having a damping member 320 fixed thereto, and two stoppers 342 and 343 protruded at a predetermined interval at the outer circumferential surface of the piston rod 320, and restricting a vertical movement of the support member 341.

With the damper 300 in accordance with the third embodiment of the present invention, if a vibration transferred to the piston rod 320 is smaller than a pre-set displacement value (F: not shown), the support member 341 does not come in contact with the stoppers 342 and 343 of the piston rod 320, so that the displacement according to the vibration of the piston rod 320 is not transferred to the cylinder 310.

In this state, if the vibration transferred to the piston rod 320 becomes stronger, an amplitude of the piston rod 320 is increased, and accordingly, the displacement of the vibration is increased to above the first displacement value (F1). Then, the support member 341 comes in contact with the stoppers 342 and 343 formed at the piston rod 320 moving together with the piston rod 320. Accordingly, the damping member 320 fixed at the support member 341 rubs on the friction face 312 of the cylinder 310, generating a damping force.

Figure 12:
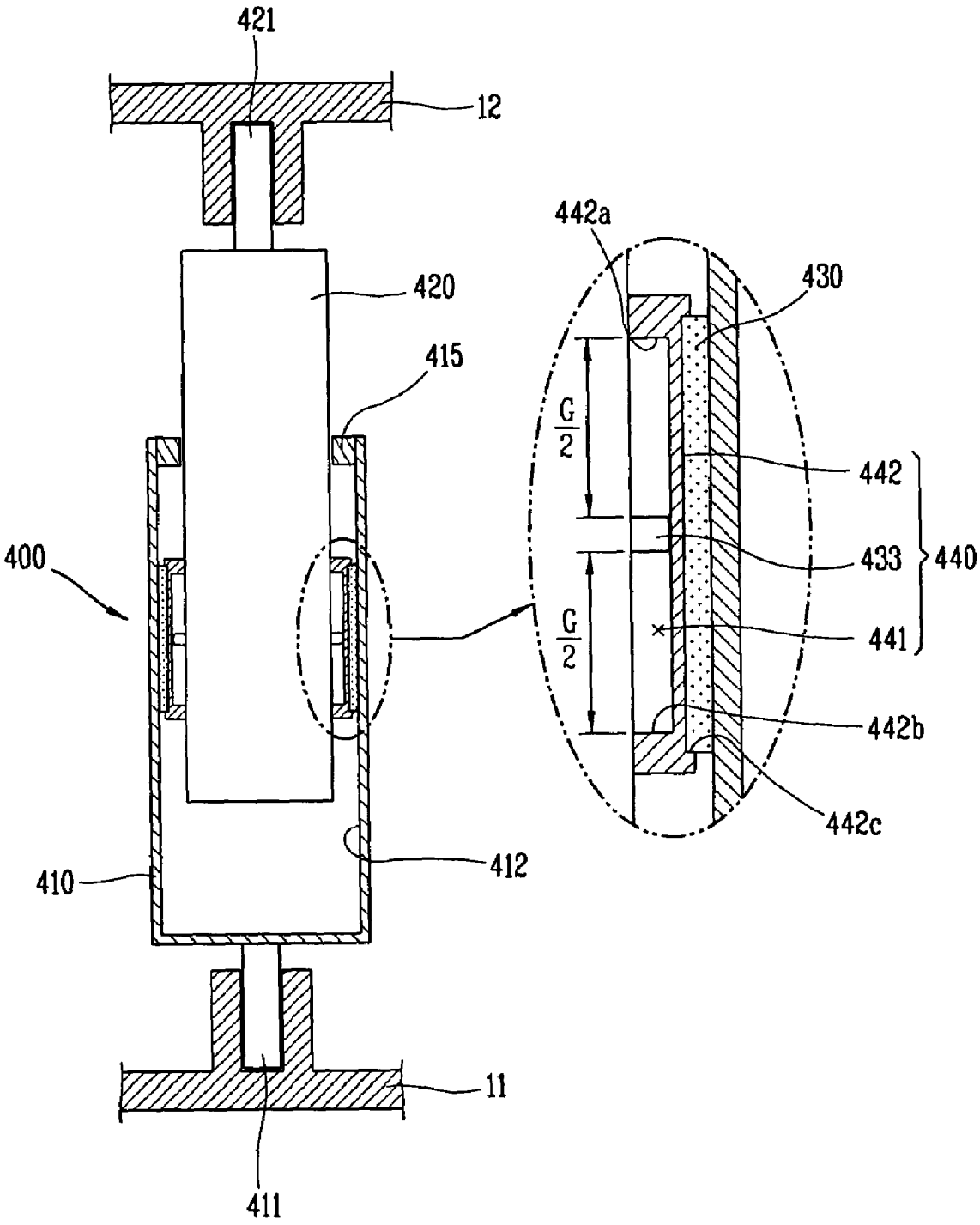
FIG. 12 is a sectional view showing a damper in accordance with a fifth embodiment of the present invention.

FIG. 12 is a sectional view showing a damper in accordance with a fifth embodiment of the present invention.

A damper 400 in accordance with the second embodiment of the present invention includes: a cylinder 410 mounted at a bottom surface of the cabinet 11, a piston rod 420 mounted at an outer circumferential surface of the tub 12 and inserted to be movable linearly into the cylinder 410, a damping member 430 mounted at the piston rod 420 and generating a damping force by rubbing on the inner circumferential surface of the cylinder 410, and a damping force transfer means 440 mounted between the piston rod 420 and the damping member 430, not transferring an operational force to the damping member 430 if a displacement value of the piston rod 420 according to a vibration generated from the tub 12 is smaller than a pre-set value, and transferring an operational force to the damping member 430 if a vibration of the tub is so strong that the displacement value of the piston rod 420 goes beyond the pre-set value.

The damping force transfer means 440 of the damper 400 in accordance with the fifth embodiment of the present invention includes a support member 442 slidably disposed at an outer circumferential surface of the piston rod 420, having a chamber 441 therein, and having a damping member 430 fixed at its outer circumferential surface; and a stopping protrusion 443 protruded from the outer circumferential surface of the piston rod 320 and movably positioned at the chamber 441 of the support member 442.

The support member 442 includes engaging jaws 442*a* and 442*b* respectively formed at its upper and lower ends. When the engaging jaws 442*a* and 442*b* slidably contact with the outer circumferential surface of the piston rod 420, the stopping protrusion 442 is engaged thereto. Inside the support member 442, there is formed the chamber 441 into which the stopping protrusions 442*a* and 442*b* are inserted to be movable in a vertical direction. A fixing groove 442*c* is formed at the outer circumferential surface of the support member 442, into which the damping member 430 is fixed.

With the damper constructed in accordance with the fouth embodiment of the present invention, if a vibration transferred to the piston rod 420 is smaller than a pre-set displacement value (G: not shown), the stopping protrusion 443 of the piston rod 420 is moved in a vertical direction within the chamber 441 to prevent transfer of the vibration of the piston rod 420 to the cabinet 11 through the cylinder 410.

In this state, if the vibration transferred to the piston rod 420 is increased strong, an amplitude of the piston rod 420 is increased, and accordingly, a displacement value of the vibration is increased beyond the first displacement value (F1). Then, the stopping protrusion 443 formed at the piston rod 420 is caught by the engaging jaw 442*a* formed at the upper and lower sides of the support member 442. Accordingly, the support member 442 is moved together with the piston rod 420, and thus, the damping member 430 fixed at the support member 442 rubs on the friction face 412 of the cylinder 410, to thereby generate a damping force.

As so far described, the damper of the present invention has the following advantages.

That is, the damper generates a damping force by stages depending on a displacement of a vibration transferred from the cylinder to the piston or from the piston to the cylinder. Accordingly, if a small amount of vibration is transferred, a weak damping force is generated, whereas if a large amount of vibration is transferred, a strong damping force is generated, so that a vibration damping performance can be improved.

In addition, if a vibration smaller than a pre-set displacement value is transferred, no damping force is generated. That is, only when a vibration greater than the pre-set displacement value is generated, a damping force is generated. Therefore, a noise occurrence is minimized and a vibration damping performance can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A damper of a drum type washing machine comprising:

a cylinder;

a piston rod inserted to be movable linearly in the cylinder;

a unitary guide member located between the piston and the cylinder provided with an internal coupling hole to which an insertion portion of the rod member is coupled at a center thereof in order to attenuate vibration according to a width size of vibration transferred to a tub by multi-stage, and provided with first and second grooves at an outer circumferential surface thereof facing the cylinder;

a fixed damping structural member fitted into the first groove and adhered to an inner surface of the cylinder; and a movable damping structural member up and down movably fitted into the second groove and to selectively come into frictional contact with the inner surface of the cylinder.

2. The daniper of claim 1, wherein the cylinder is provided with a fixed portion to be fixed to a cabinet of a drum type washing machine at one side thereof and is provided with an accommodation portion at another side thereof, and the piston rod is provided with a fixed portion to be fixed to a tub of the drum type washing machine at one side thereof and is provided with an insertion portion elastically inserted into the accommodation portion at another side thereof.

3. The damper of a drum type washing machine of claim 2, wherein an inclination surface that a middle portion thereof is more concaved than both ends is formed at a bottom surface of the second groove.

4. The damper of a drum type washing machine of claim 1, wherein stoppers adhered to an inner surface of the cylinder are formed at both sides of the first and second grooves.

5. A damper of a drum type washing machine comprising:

a cylinder;

a piston rod inserted to be movable linearly in the cylinder;

a guide member provided with a coupling hole to which an insertion portion of the rod member is coupled at a center thereof in order to attenuate vibration according to a width size of vibration transferred to a tub by multi-stage, and provided with first and second grooves at an outer circumferential surface thereof and provided with stoppers formed at both sides of the first and second grooves;

a fixed damping structural member lined into the first groove and movably contacted to an inner surface of the cylinder; and a movable damping member up and down movably fitted into the second groove, not contacted to the inner surface of the cylinder in case that the width size of vibration transferred to the tub is relatively less and movably contacted to the inner surface of the cylinder for sliding by the stopper in case that the width size of vibration transferred to the tub is relatively great.

* * * * *